US007695069B2

(12) United States Patent
Prust

(10) Patent No.: US 7,695,069 B2
(45) Date of Patent: Apr. 13, 2010

(54) SEAT CUSHION

(76) Inventor: Peter C. Prust, 402 Shoemaker Dr., Carmel, IN (US) 46032-9793

( * ) Notice: Subject to any disclaimer, the term of this patent is extended or adjusted under 35 U.S.C. 154(b) by 0 days.

(21) Appl. No.: 11/779,861

(22) Filed: Jul. 18, 2007

(65) Prior Publication Data

US 2008/0030062 A1 Feb. 7, 2008

Related U.S. Application Data

(63) Continuation-in-part of application No. 11/489,010, filed on Jul. 19, 2006, now abandoned.

(60) Provisional application No. 60/916,217, filed on May 4, 2007.

(51) Int. Cl.
*A47C 7/02* (2006.01)

(52) U.S. Cl. ..... 297/452.45; 297/452.46

(58) Field of Classification Search ..... 297/452.45, 297/452.46, 452.43; 108/57.28; 5/652.1, 5/653, 724, 944
See application file for complete search history.

(56) References Cited

U.S. PATENT DOCUMENTS 1,296,359 A 3/1919 Brown
1,922,228 A 8/1933 Brown
1,982,516 A * 11/1934 Holmested ..... 297/452.45
2,082,151 A 6/1937 De Poix
2,434,641 A 1/1948 Burns
3,231,454 A 1/1966 Williams
3,468,311 A 9/1969 Gallagher
3,514,156 A * 5/1970 Fields ..... 297/452.45
3,553,748 A 1/1971 Ross
3,605,145 A 9/1971 Graebe (Continued)

FOREIGN PATENT DOCUMENTS

GB 2274054 7/1994

(Continued)

OTHER PUBLICATIONS

Search Report dated Nov. 27, 2007 for PCT Application PCT/US2007/073819.

(Continued)

*Primary Examiner*—David Dunn
*Assistant Examiner*—James Alex
(74) *Attorney, Agent, or Firm*—James P. Muraff; Neal, Gerber & Eisenberg LLP

(57) ABSTRACT

A seat cushion having a flexible and semi-rigid body is provided. The body has a seating surface, having a first area, and a support surface, having a second area, spaced apart from the seating surface forming a body thickness. The body has a body composition with a first percentage by volume of EVA (Ethyl Vinyl Acetate), substantially evenly mixed with additional materials, such as polyethylene, color pigment, polycarbonate, and/or dicumyl peroxide, in various percentages of the body composition. The seat cushion also has a plurality of spacing members spaced apart and substantially evenly distributed across the second area. The plurality of spacing members each have a spacing member composition with a second percentage by volume of EVA and with a third percentage by volume of rubber. The seat cushion further has a plurality of ventilation holes extending through the body from the seating surface to the support surface.

49 Claims, 12 Drawing Sheets

U.S. PATENT DOCUMENTS 4,070,719 A 1/1978 Morgan
4,143,916 A 3/1979 Trotman et al.
4,194,255 A 3/1980 Poppe
4,205,880 A * 6/1980 Trotman et al. ..... 297/452.45
D262,590 S 1/1982 Trotman et al.
4,435,015 A * 3/1984 Trotman et al. ..... 297/452.45
4,529,248 A * 7/1985 Trotman et al. ..... 297/452.45
4,605,582 A 8/1986 Sias et al.
4,673,452 A 6/1987 Awdhan
4,673,605 A 6/1987 Sias et al.
4,686,724 A 8/1987 Bedford
D294,212 S 2/1988 Sias et al.
4,866,800 A 9/1989 Bedford
4,892,353 A * 1/1990 Goddard ..... 297/224
4,989,284 A 2/1991 Gamm
5,010,609 A 4/1991 Farley
5,015,037 A 5/1991 Giblin et al.
D323,092 S 1/1992 Fenner, Sr.
5,079,790 A 1/1992 Pouch
D329,566 S 9/1992 Davidson, Jr.
5,160,785 A 11/1992 Davidson, Jr.
5,243,722 A 9/1993 Gusakov
5,286,089 A 2/1994 Goldman
D345,072 S 3/1994 Rose et al.
5,294,181 A 3/1994 Rose et al.
5,325,552 A 7/1994 Fong
D355,558 S 2/1995 Graebe
5,402,545 A 4/1995 Jolley
5,411,318 A * 5/1995 Law ..... 297/452.45
5,444,881 A 8/1995 Landi et al.
5,459,896 A 10/1995 Raburn et al.
D372,157 S 7/1996 Bonaddio et al.
D375,863 S 11/1996 Bigolin
5,607,749 A 3/1997 Strumor
D378,968 S 4/1997 Martin et al.
5,628,079 A * 5/1997 Kizemchuk et al. ..... 5/653
5,645,314 A 7/1997 Liou
5,692,952 A * 12/1997 Chih-Hung ..... 454/120
D389,692 S 1/1998 Graebe et al.
D389,702 S 1/1998 Graebe et al.
D391,110 S 2/1998 Graebe
5,749,111 A 5/1998 Pearce
6,009,578 A 1/2000 Davis
6,018,832 A 2/2000 Graebe
D449,170 S 10/2001 Kim
6,701,556 B2 3/2004 Romano et al.
6,726,285 B2 * 4/2004 Caruso et al. ..... 297/452.32
D497,761 S 11/2004 Martin
6,818,676 B2 * 11/2004 Koffler et al. ..... 521/140
6,901,617 B2 6/2005 Sprouse, II et al.
6,938,290 B2 9/2005 McKinney et al.
7,083,236 B1 * 8/2006 Smith ..... 297/452.43
7,120,956 B1 10/2006 Liao
2002/0185898 A1 * 12/2002 Smith ..... 297/224
2003/0037377 A1 2/2003 Kawamura et al.
2004/0098806 A1 5/2004 Stender et al.

FOREIGN PATENT DOCUMENTS

JP 2006-95101 4/2006
JP 2006-095101 4/2006

OTHER PUBLICATIONS

International Preliminary Report on Patentability for International PCT Application PCT/US2007/073819.

* cited by examiner

SEAT CUSHION

CROSS REFERENCE TO RELATED APPLICATIONS

This application claims priority from and is a continuation-in-part of U.S. patent application Ser. No. 11/489,010, entitled "Seat Cushion," filed on Jul. 19, 2006, and claims priority from U.S. Patent Application Ser. No. 60/916,217, entitled "Seat Cushion,"filed May 4, 2007, both of which are incorporated herein by reference.

TECHNICAL FIELD

The present invention relates to human seating comfort, and, more particularly, to a seat cushion, with at least improved stability, durability, comfort, and ease of transport.

BACKGROUND

Sporting and entertainment facilities typically provide seating areas including one or more sections of solid surface seating, such as benches or bleachers, that are hard and uncomfortable to sit on for extended seating periods. Such solid surface seating, for example, may be made from metal or wood, and may be thermally conductive. Accordingly, on particularly hot or cold days, for example, such benches or bleachers may add to seating discomfort by transmitting the cold or heat directly to a person's posterior.

Attempts have been made to reduce seating discomfort by proving a cushion that has a substantially continuous and uniform thickness. Such cushions may be made, for example, foam or other materials. Such cushions, while softening the seating surface over that of a solid surface, substantially block air flow to the person's posterior, thereby adding to the person's thermal and sweating discomfort. In addition, prior seat cushions, when made from rubber, are heavy are not easy to transport from, for example the trunk of the user's automobile, to a stadium seat. Further, when made from a foam, the seat cushion may not have a sufficient level of rigidity to support the user without bending or collapsing the seat cushion structure. Moreover, prior seat cushions were not easy to clean, to remove stains or the smell of beverages which may have spilled on such prior seat cushions.

SUMMARY OF THE INVENTION

The present invention is directed to a seat cushion. The seat cushion has a flexible and semi-rigid body. The body has a seating surface and a support surface spaced apart from the seating surface forming a body thickness. The seating surface has a first area and the support surface has a second area. The body has a body composition with a first percentage by volume of EVA (Ethyl Vinyl Acetate) and wherein the EVA is substantially evenly mixed throughout the body composition with additional materials in respective percentages. The additional materials can include polyethylene, color pigment, polycarbonate, and/or dicumyl peroxide, in various percentages of the body composition.

The seat cushion also has a plurality of spacing members spaced apart and substantially evenly distributed across the second area. Each of the plurality of spacing members extends outwardly in a first direction from the support surface. The plurality of spacing members each has a spacing member composition with a second percentage by volume of EVA and with a third percentage by volume of rubber. The EVA and the rubber are substantially evenly mixed throughout the composition of the plurality of spacing members with one or more additional materials identified above, in respective percentages.

The seat cushion further has a plurality of ventilation holes extending through the body from the seating surface to the support surface. The plurality of ventilation holes are distributed among the plurality of spacing members and spaced to facilitate ventilation around and between the plurality of spacing members to the plurality of ventilation holes.

The percentages of the EVA, rubber and/or additional materials are significant for the compositions of the body and the spacing members for achieving an optimal mix of rigidity and flexibility for support and comfort of use.

In one embodiment, the spacing members are spaced in a two-dimensional pattern which is defined by a matrix of grid points with each spacing member of the plurality of spacing members being located at each grid point of the matrix of grid points.

In another embodiment, each of the plurality of spacing members respectively extend outward from the support surface in the first direction an equal distance in a range of about 1.5 to about 3.0 centimeters.

In another embodiment, the flexible body and the plurality of spacing members are formed as a one-piece unitary structure.

In another embodiment the body and spacing member compositions are closed-cell compositions, which provides for substantial non-porous qualities, such as being water resistant and/or water proof (no water soaking into the composition).

In another embodiment, the plurality of spacing members are sized in length in the first direction and sized in cross-sectional area orthogonal to the length, in combination with the composition, to substantially support the body without significant flexing of the spacing members or body.

In another embodiment, the cross-sectional area of each of the plurality of spacing members is in a range of about four square centimeters to about nine square centimeters.

In another embodiment, the seat cushion also has a fabric cover having an elastic perimeter for positioning and maintaining the fabric cover over the seating surface. The fabric cover can have a logo, a symbol, or a design formed on or in the fabric of the fabric cover.

In another embodiment, the plurality of spacing members are distributed on the support surface in a first two-dimensional pattern, and the plurality of ventilation holes are distributed in the flexible body in a second two-dimensional pattern interspersed with the plurality of spacing members. The first two-dimensional pattern is defined by a first matrix of grid points with each spacing member of the plurality of spacing members being located at each grid point of the first matrix of grid points. The second two-dimensional pattern is defined by a second matrix of grid points with each ventilation hole of plurality of ventilation holes being located at each grid point of the second matrix of grid points.

In another embodiment, cross-sectional area of each of the plurality of ventilation holes is in a range of about three square centimeters to about nine square centimeters.

In another embodiment, the plurality of spacing members and the flexible body are the only structural elements which provide support for a user sitting on the seating surface of the seat cushion when the spacing members are placed on a solid surface.

In another embodiment, the body comprises a plurality of recesses located on the support surface of the body. Each of the plurality of recesses has a recessed surface and a side wall.

Each of the plurality of recesses receives each of the plurality of spacing members. A water-resistant glue is used to connect each spacing member to at least the recess surface of each respective recess of the plurality of recesses, for connecting and permanently securing the spacing members to the body.

In another embodiment, each spacing member has a spacing ventilation hole substantially centered within each spacing member and parallel to the length of each spacing member. Each spacing ventilation hole continues from each spacing member through the support surface of the flexible body, through the flexible body and through the seating surface of the flexible body.

In another embodiment, the seat cushion can further have a flexible and semi-rigid back body with a plurality of back body ventilation holes therein, similar to the above-mentioned body and ventilation holes therein. The back body can have a backing surface and a back support surface spaced apart from the backing surface forming a back body thickness. The back surface has a first backing area and the back support surface has a second back support area. The back body has a back body composition comprising EVA. The plurality of back body ventilation holes extend through the back body from the backing surface to the back support surface. The back body can also have back body spacing members, and other elements used in relation to the body.

Other features and advantages will become apparent with reference to the below-described figures, detailed description and claims.

BRIEF DESCRIPTION OF THE DRAWINGS

The above-mentioned and other features and advantages of this invention, and the manner of attaining them, will become more apparent and the invention will be better understood by reference to the following description of various embodiments taken in conjunction with the accompanying drawings, wherein.

DETAILED DESCRIPTION

Figure 1:
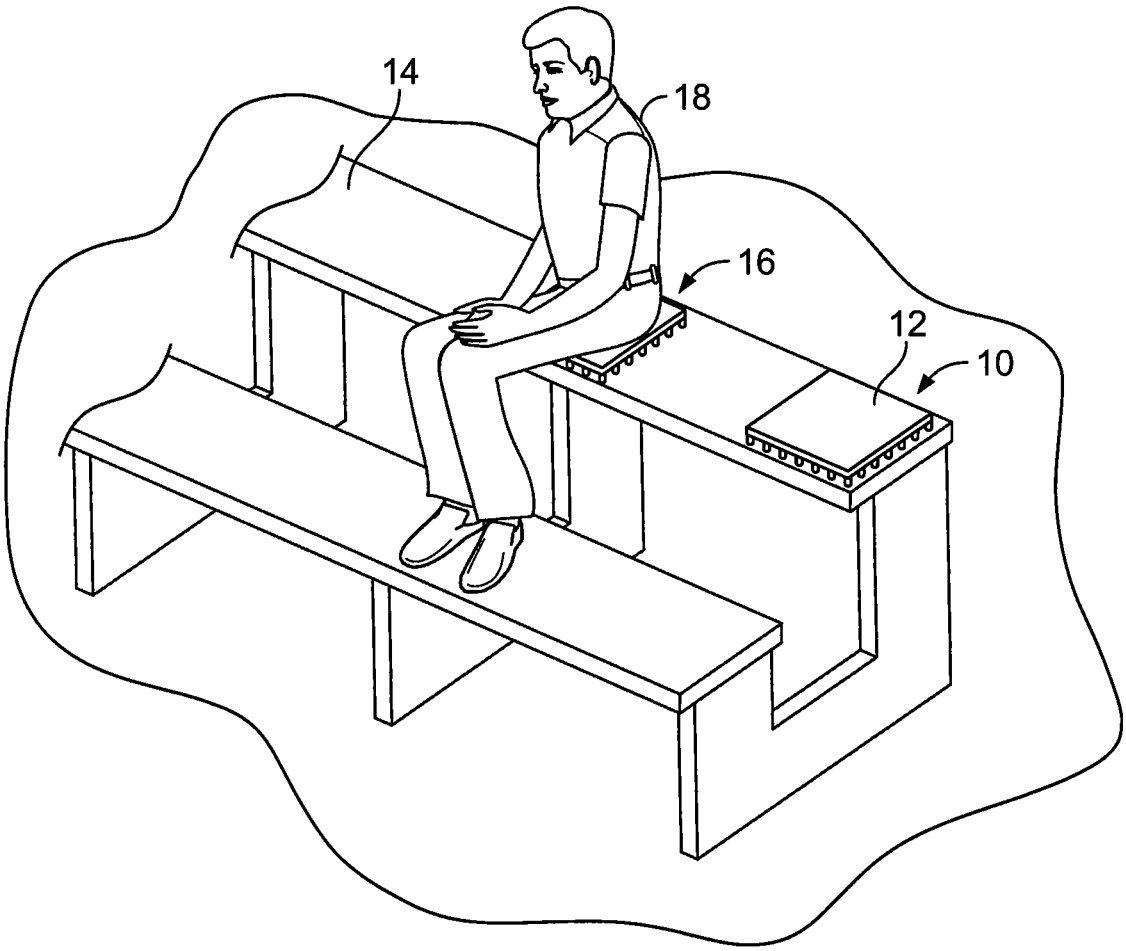
FIG. 1 is a perspective view showing a seat cushion of one embodiment of the present invention, with an optional fabric cover, positioned on a sitting surface.

FIG. 1 is a perspective view showing a seat cushion 10, which is configured in accordance with the various embodiments of the present invention. In FIG. 1, seat cushion 10 is fitted with an optional fabric cover 12. Seat cushion 10 may be positioned directly on a sitting surface 14, such as for example, to be used in portable stadium-events seating, such as a stadium or arena bleacher. Other uses of seat cushion 10 include, for example: placement of seat cushion 10 on the seat of a motorized vehicle, e.g., an auto, motorcycle, tractor, etc; on the ground, for example to be used for outdoor music or sporting events; and on seating surfaces in, for example, homes, commercial sites, e.g., shopping malls, industrial sites, e.g., factories, offices, etc. Other examples of the use of the seat cushion can include more permanent settings, such as for example being incorporated into the structural design of stadium seating, office furniture, automobile seating, boating industry seating, train seating, airline seating, heavy equipment seating, as well as the use within or in combination with bedding components. Also shown in FIG. 1 is another seat cushion 16, identical to seat cushion 10, with a human user 18 sitting thereon. Seat cushion 10 (16) is configured, as described in more detail below, so as to enhance the seating comfort for the user 18 over that available from sitting directly on sitting surface 14. The various embodiments of the seat cushion 10 of the present invention help to protect user's from lower back and spine jarring, as well as to reduce the fatigue and discomfort on muscles and joints.

Referring now to FIGS. 2-6, where is shown various views of seat cushion 10, with fabric cover 12 removed for clarity. In the present embodiment, seat cushion 10 includes a flexible and semi-rigid body 20 and a plurality of spacing members 22. Also, in the present embodiment flexible body 20 includes a plurality of ventilation holes 24. Flexible body and the plurality of spacing members 22 may be formed, for example, as a one-piece or multi-piece unitary structure from a closed cell composition, such as for example, a closed-cell structure having a hardness of about 40 on the Shore durometer scale. The components and/or structure described herein may be fabricated using injection molding techniques known in the art.

Flexible body 20 has a seating surface 26 and a support surface 28 spaced apart from seating surface 26. In the present embodiment, the thickness T of flexible body 20 from seating surface 26 to support surface 28 may be, for example, in a range of about 0.4 to 1.0 centimeters. In one preferred embodiment, thickness T is ⅝ inches. Seating surface 26 has a first area A1 and support surface 28 has a second area A2. In the present embodiment areas A1 and A2 are substantially equal. Also, in the present embodiment, areas A1 and A2 are substantially square, but those skilled in the art will recognize that other shapes may be desirable, such as for example, elongated rectangular, oval, circular, etc., for reasons such as those due to the size or shape of the sitting surface, e.g., sitting surface 14, on which seat cushion 10 is to be placed. In the present embodiment, for example, each of areas A1 and A2 is about 1450 square centimeters, but those skilled in the art will recognize that other area sizes may be desirable, such as due to the size of the user, e.g., large adult, small adult, child, etc.

Figure 3:
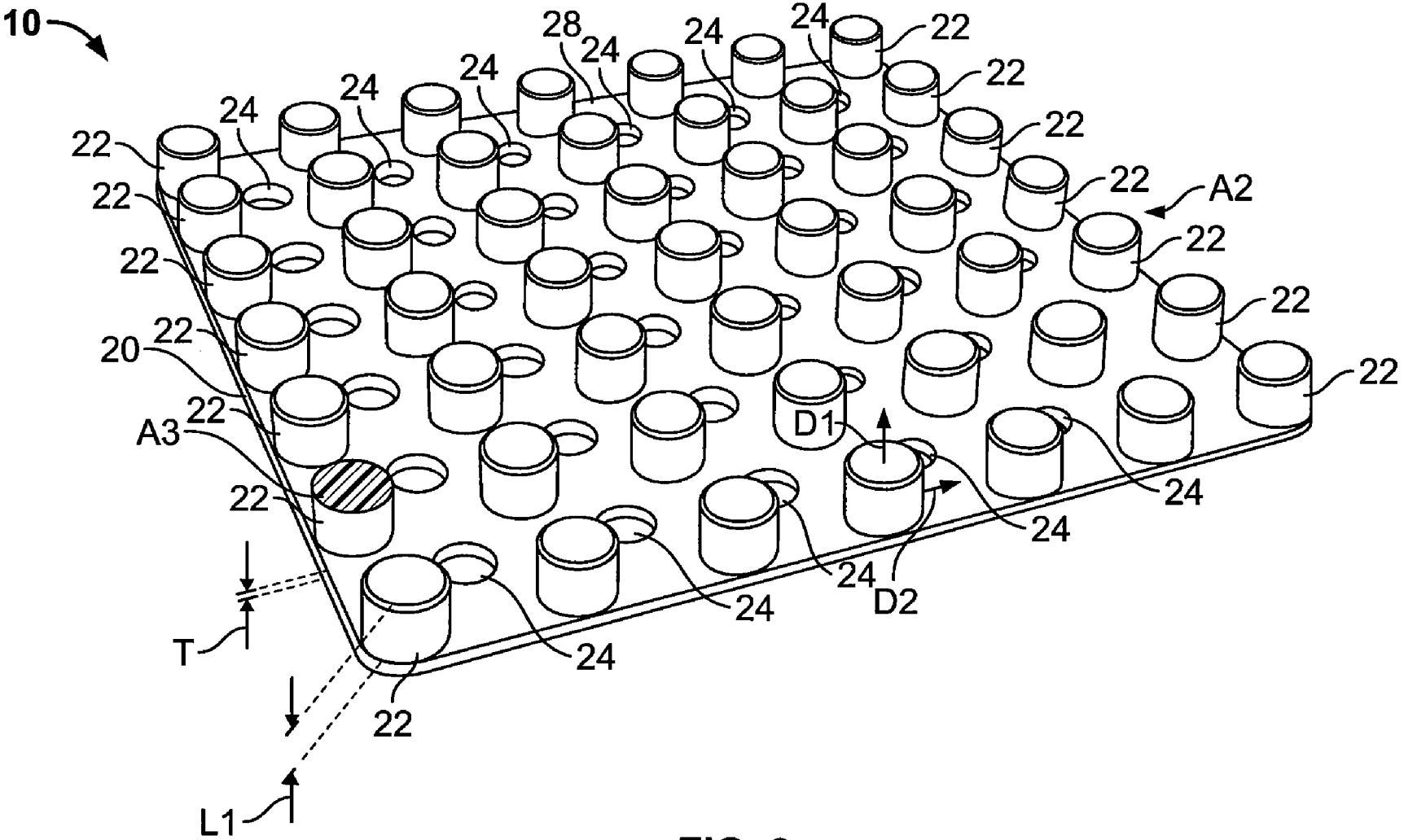
FIG. 3 is another perspective view of the seat cushion of FIG. 2, viewed from the support surface side.
Figure 4:
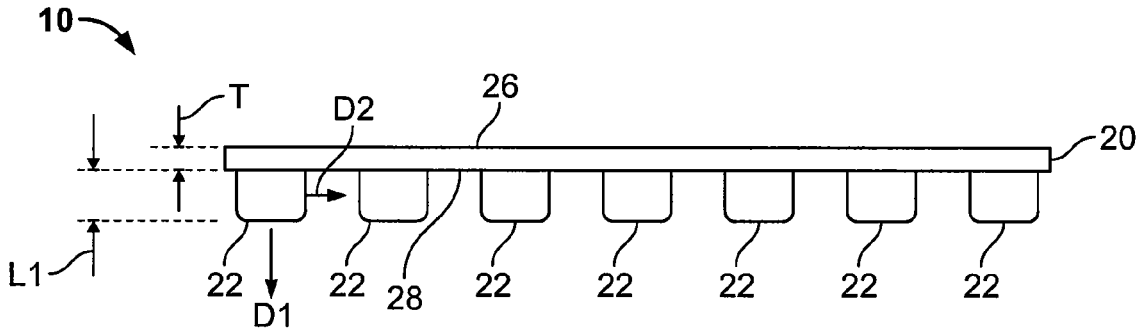
FIG. 4 is a side view of the seat cushion of FIG. 2.
Figure 6:
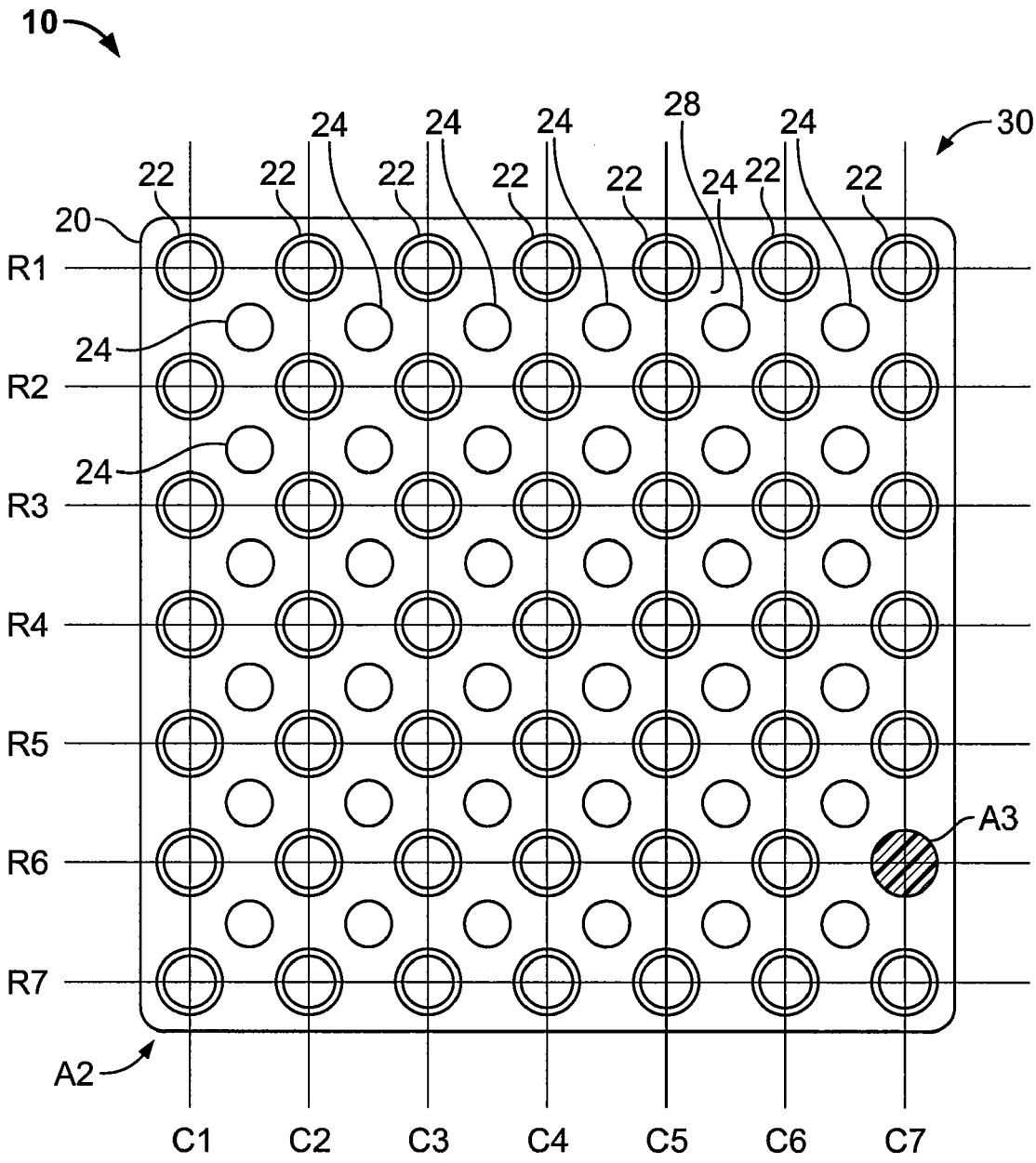
FIG. 6 is a bottom view of the seat cushion of FIG. 2.

As best shown in FIGS. 3, 4, and 6, the plurality of spacing members 22 are spaced apart and distributed across the second area A2, with each of the plurality of spacing members 22 extending perpendicularly outwardly in a first direction D1 from support surface 28. The plurality of spacing members 22 is distributed on support surface 28 in a two-dimensional pattern. Referring to FIG. 6, in the present embodiment the two-dimensional pattern 30 is defined by a matrix of grid points at the intersections of the rows Rx (e.g., rows R1-R7) and columns Cx (e.g., columns C1-C7) of the matrix, with one spacing member of the plurality of spacing members 22 being located at each grid point of the matrix of grid points. In the present embodiment, the two-dimensional pattern 30 is a rectangular grid having at least three rows of spacing members 22 and at least three columns of spacing members 22, e.g., preferably 7 rows×7 columns for a total of 49 spacing members 22. Preferably, in one embodiment, the diameter of each of the spacing members 22 is 1.5 inches.

In the present embodiment, each of the plurality of spacing members 22 respectively extend outwardly from the support surface 28 in the first direction D1 (see FIGS. 3 and 4) an equal distance, i.e., length L1, in a range of, for example, about 1.5 to about 3.0 centimeters. In one preferred embodiment, L1 is ⅜ inches. Each of the plurality of spacing members 22 formed from the compound or composition, and distributed across the second area A2 of support surface 28 are sized in length L1 in the first direction D1 and sized in cross-sectional area A3 orthogonal to the length L1 to be substantially non-flexible in a direction D2 radially perpendicular to the first direction D1. In the present embodiment, for example, the cross-sectional area A3 of each of the plurality of spacing members 22 may be in a range of about four square centimeters to about nine square centimeters.

As a general design criteria, as length L1 increases cross-sectional area A3 may increase as well to retain the desired level on non-flexibility, e.g., support. While each of the plurality of spacing members 22 may be substantially non-flexible in direction D2 radially perpendicular to the first direction D1, the composition provides a level of compression along the length L1 to provide a cushioning effect. In addition, the flexible body 20 is flexible and pliable as a combined effect its thickness T, the quantity and size of the plurality of ventilation holes 24, and/or the characteristics of the composition.

Figure 2:
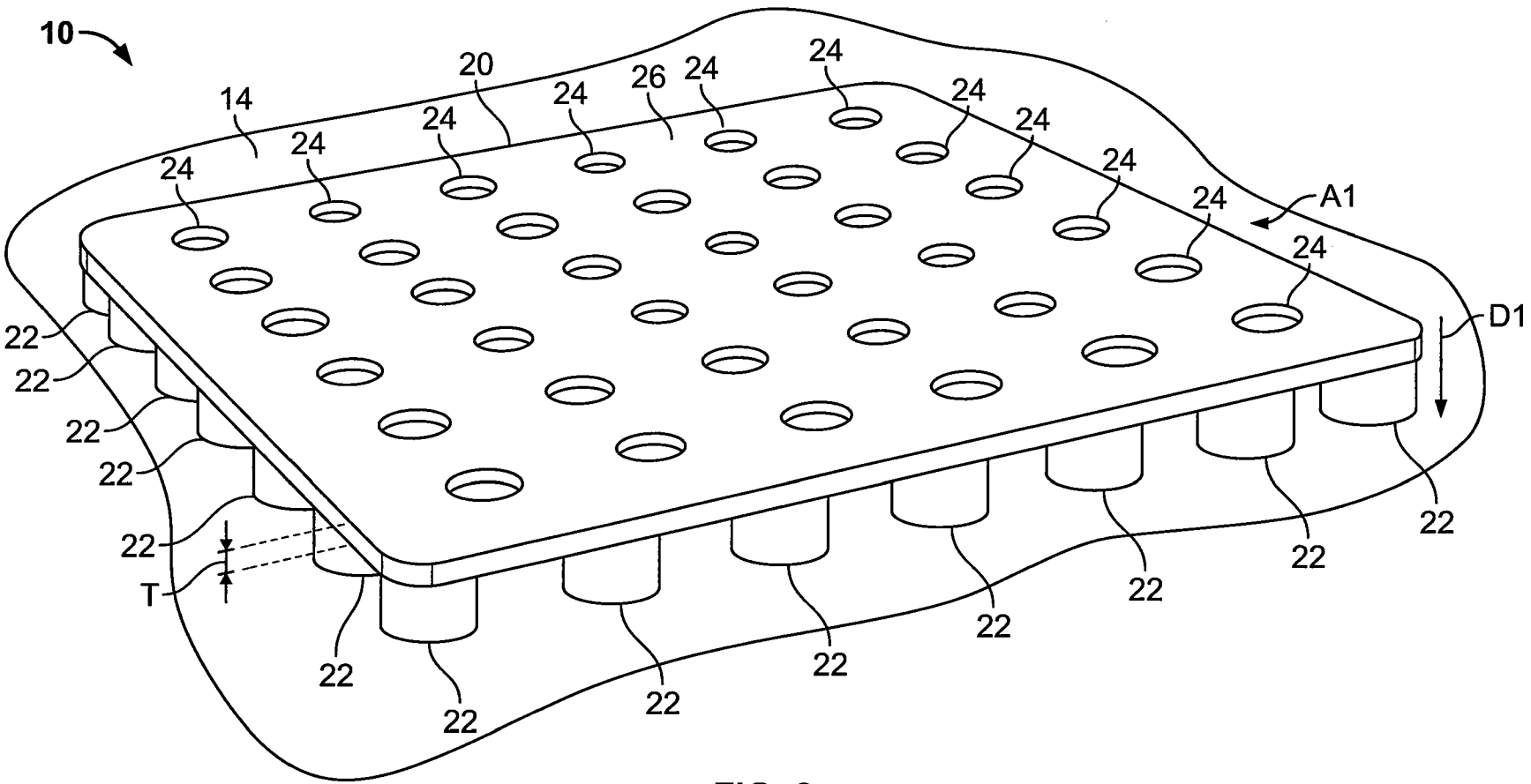
FIG. 2 is a perspective view of the seat cushion of FIG. 1, with the fabric cover removed, viewed from the seating surface side.

As best shown in FIGS. 2 and 3, the plurality of ventilation holes 24 extend through the flexible body 20 from the seating surface 26 through to support surface 28, with the plurality of ventilation holes 24 being disturbed among the plurality of spacing members 22. The plurality of spacing members 22 are spaced and positioned in relation to the plurality of ventilation holes 24 to facilitate ventilation around and between the plurality of spacing members 22 to, up and through the plurality of ventilation holes 24.

Figure 5:
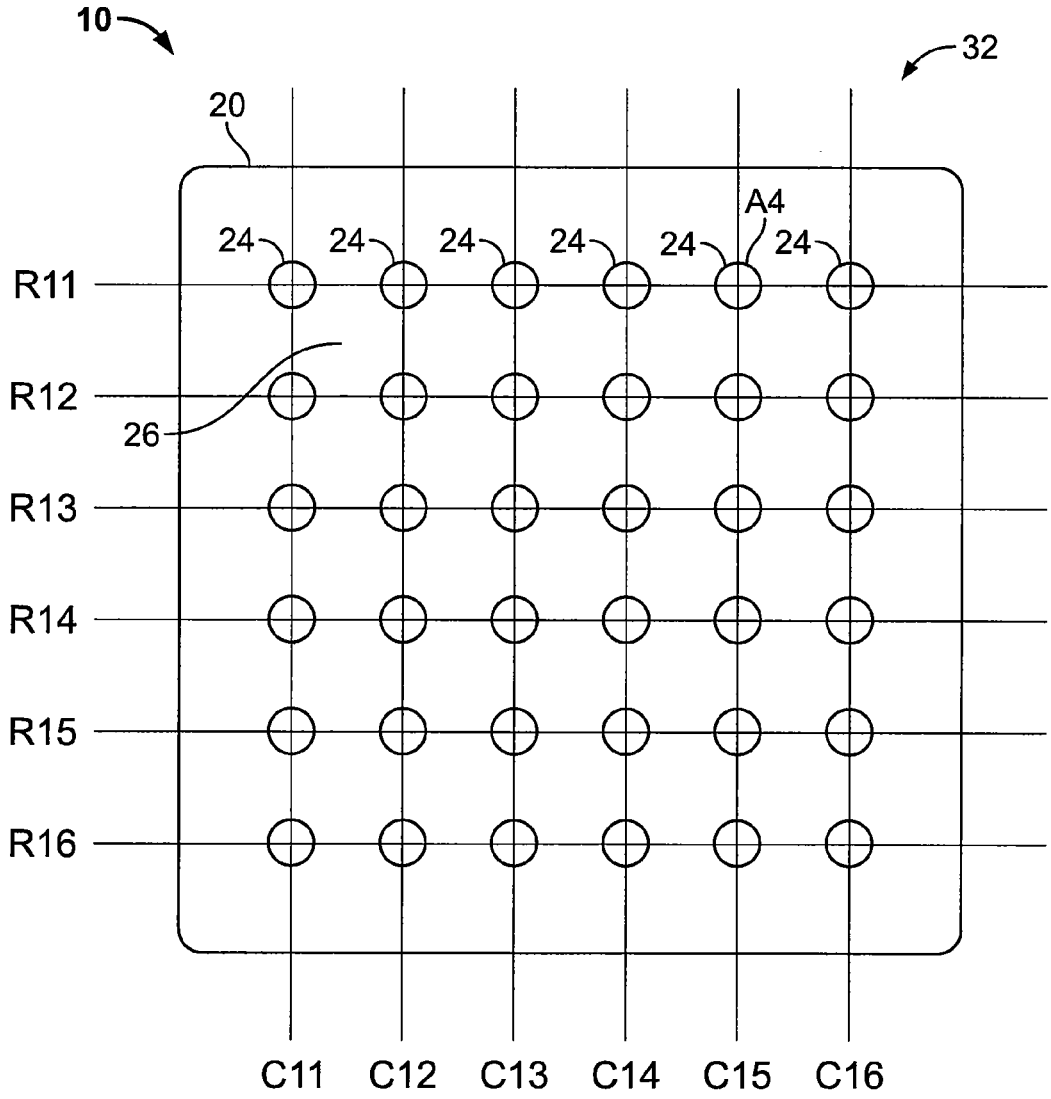
FIG. 5 is a top view of the seat cushion of FIG. 2.

Referring also to FIG. 5, in the present embodiment, the plurality of ventilation holes 24 are distributed in flexible body 20 in a two-dimensional pattern 32 interspersed with the plurality of spacing members 22 that are arranged in the two-dimensional pattern 30 shown in FIG. 6. In the present embodiment, the two-dimensional pattern 32 is defined by a matrix of grid points at the intersections of the rows R1x (e.g., rows R11-R16) and columns C1y (e.g., columns C11-C16) of the matrix, with one ventilation hole of the plurality of plurality of ventilation holes 24 being located at each grid point of the matrix of grid points. In the present embodiment, the two-dimensional pattern 32 is a rectangular grid having at least two rows of ventilation holes 24 and at least two columns of ventilation holes 24, e.g., preferably 6 rows×6 columns for a total of 36 ventilation holes 24. Preferably, in one embodiment, the diameter of each of the ventilation holes 24 is 1 inch.

A cross-sectional area A4, i.e., the opening size, of each of the plurality of ventilation holes 24 may be, for example, in a range of about three square centimeters to about nine square centimeters. The size and quantity of ventilation holes 24 may be chosen to provide the desired amount of ventilation to the human user 18, while not compromising the structural integrity of flexible body 20. While the present embodiment includes the plurality of ventilation holes 24, it is contemplated that some users may not desire to have the ventilation holes, and thus in some embodiments of the present invention, the inclusion of the plurality of ventilation holes 24 may be optional. Also, for additional ventilation, it is contemplated that additional ventilation holes may be formed through one or more of the plurality of spacing members 22, and through flexible body 20 to seating surface 26.

Figure 7:
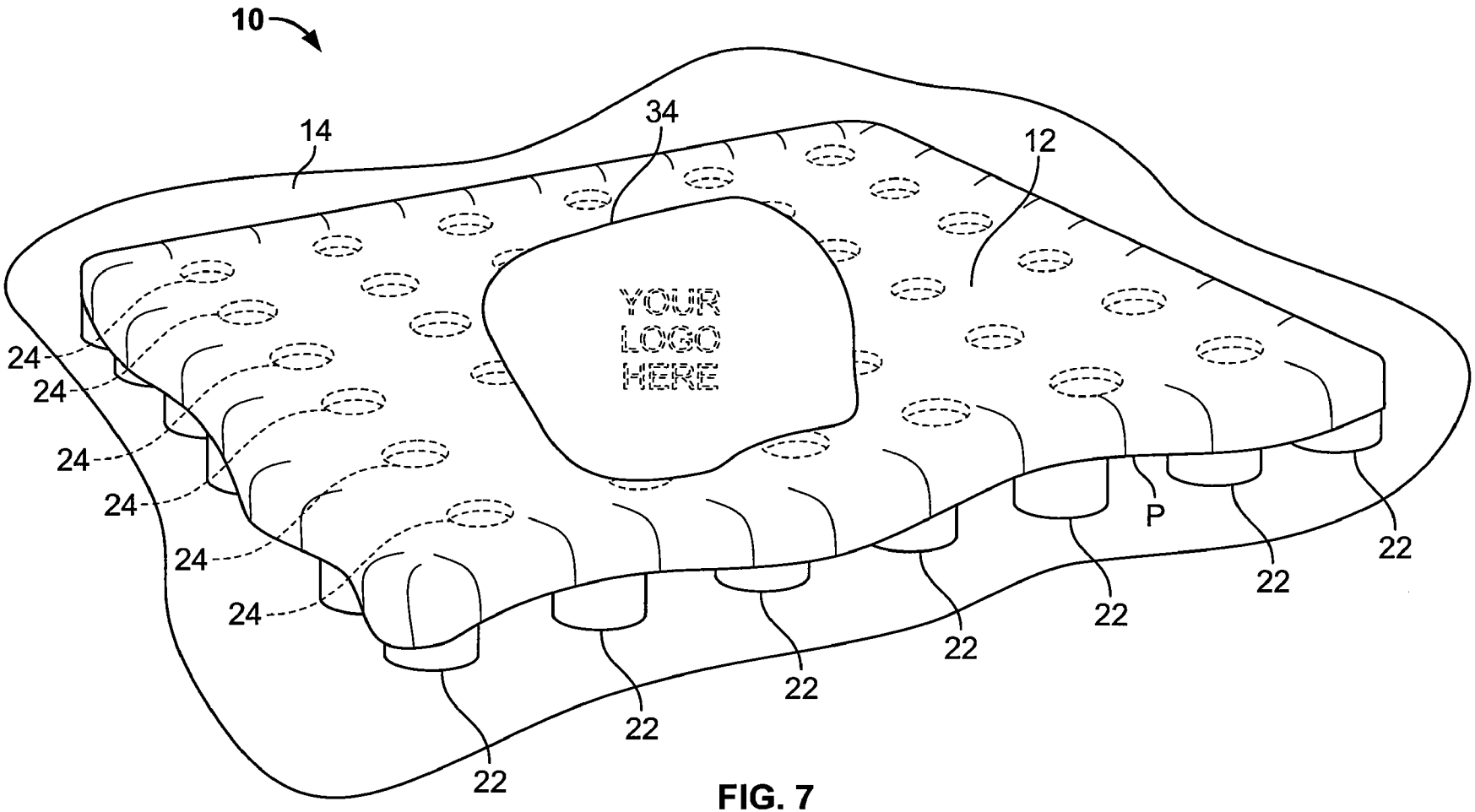
FIG. 7 is the perspective view of the seat cushion of FIG. 2 with the fabric cover installed.

FIG. 7 is the perspective view of the seat cushion 10 of FIG. 2 with the fabric cover 12 installed. Fabric cover 12 may be made from a porous, i.e., breathable, fabric, and is positioned over seating surface 26 and ventilation holes 24, and around at least a portion of the plurality of spacing members 22. An elastic band installed along the perimeter P of the fabric may be used to hold fabric cover 12 on seat cushion 10. Fabric cover 12 may provide, for example, the wicking away of moisture from the user 18 seated on seat cushion 10, while maintaining a ventilation path to the posterior of the user 18 sitting on seat cushion 10.

If desired, fabric cover 12 may include, for example, a logo, a symbol, or a design, 34, formed on or in the fabric of fabric cover 12. In one embodiment, the logo, symbol, or design can be screen printed onto the fabric.

FIGS. 8-14, show various views of other embodiment of seat cushion 10. In one embodiment, seat cushion 10 includes a flexible and semi-rigid body 80, a plurality of spacing members 82, and a plurality of ventilation holes 84. The body 80, the plurality of spacing members 82, and the plurality of ventilation holes 84 may be formed, for example, as a one-piece unitary structure that may be fabricated using injection molding techniques known in the art. The seat cushion is constructed of materials that allow for simple clean-up, for example, by placing the seat cushion in a dishwasher.

The body 80 has a seating surface 86 and a support surface 88 spaced apart from the seating surface 86. The body 80 has a body thickness T8 which is formed by the seating surface 86 and support surface 88. The body thickness T8 may be, for example, in a range of about 0.4 to 1.0 centimeters. Seating surface 86 has a first area A18, and the support surface 88 has a second area A28. The body 80 is composed of a first percentage by volume of Ethyl Vinyl Acetate Copolymer (EVA), which is evenly mixed throughout the body composition with additional materials in respective percentages. EVA exhibits qualities of flexibility and softness, and is known to be used for footwear. The use of EVA in this invention provides significant support and rigidity, yet absorption to the user's posterior and lower back. The additional materials may include, at a minimum, polyethylene (PE), color pigment, polycarbonate, and dicumyl peroxide (DCP). The body may have a fourth percentage of PE, a fifth percentage of color pigment, a sixth percentage of polycarbonate, and a seventh percentage of DCP. The percentages of EVA and additional materials in the body 80 are selected to achieve substantial stability of the body 80 and to provide a light volume seat cushion 10. The body may also contain a percentage of rubber.

Figure 9:
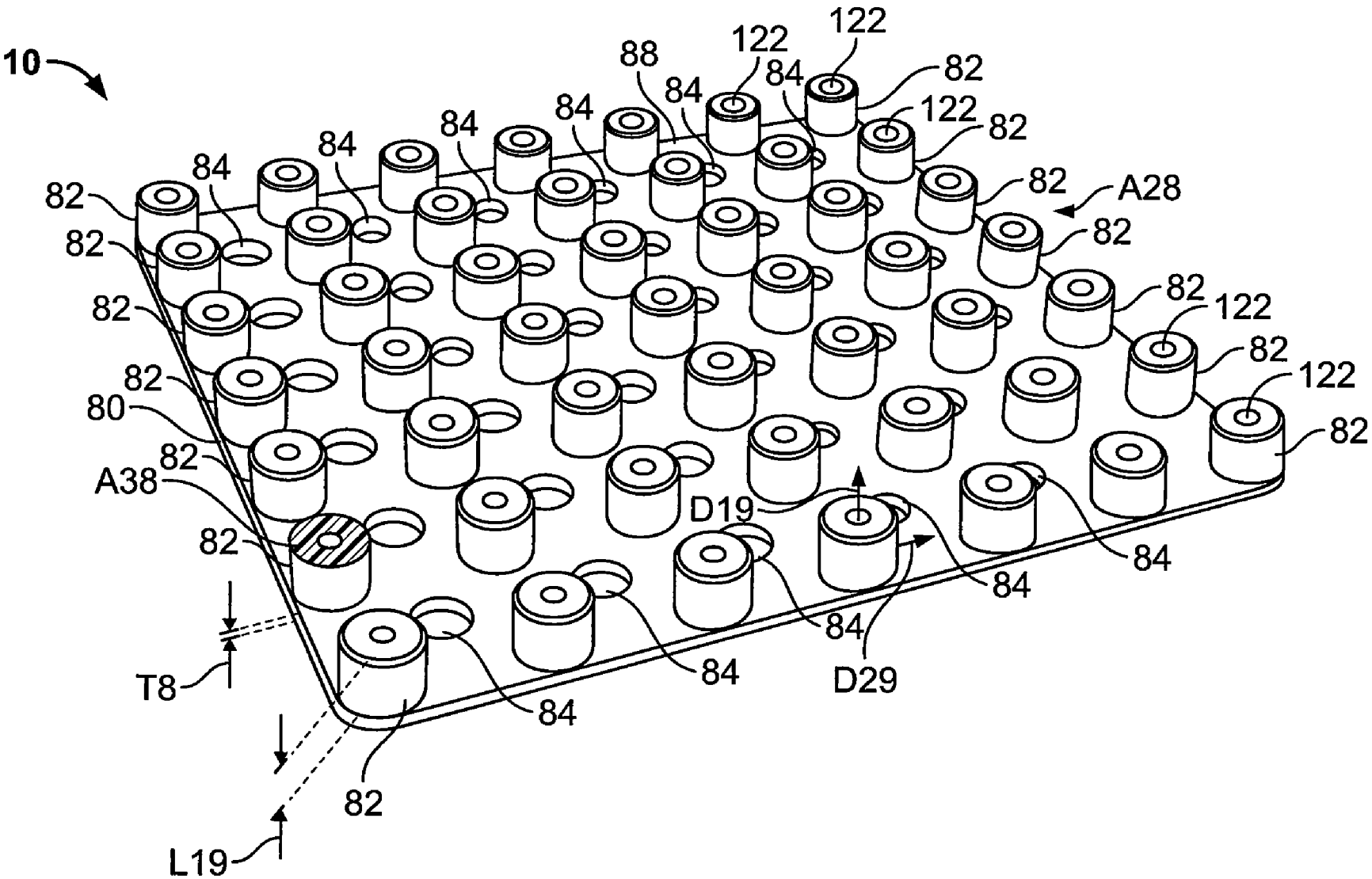
FIG. 9 is another perspective view of the seat cushion of FIG. 8, viewed from the support surface side.
Figure 10:
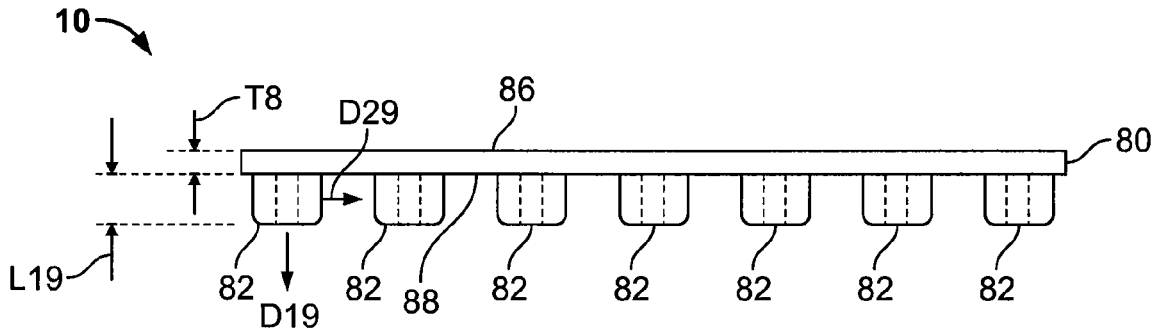
FIG. 10 is a side view of the seat cushion of FIG. 8.
Figure 11:
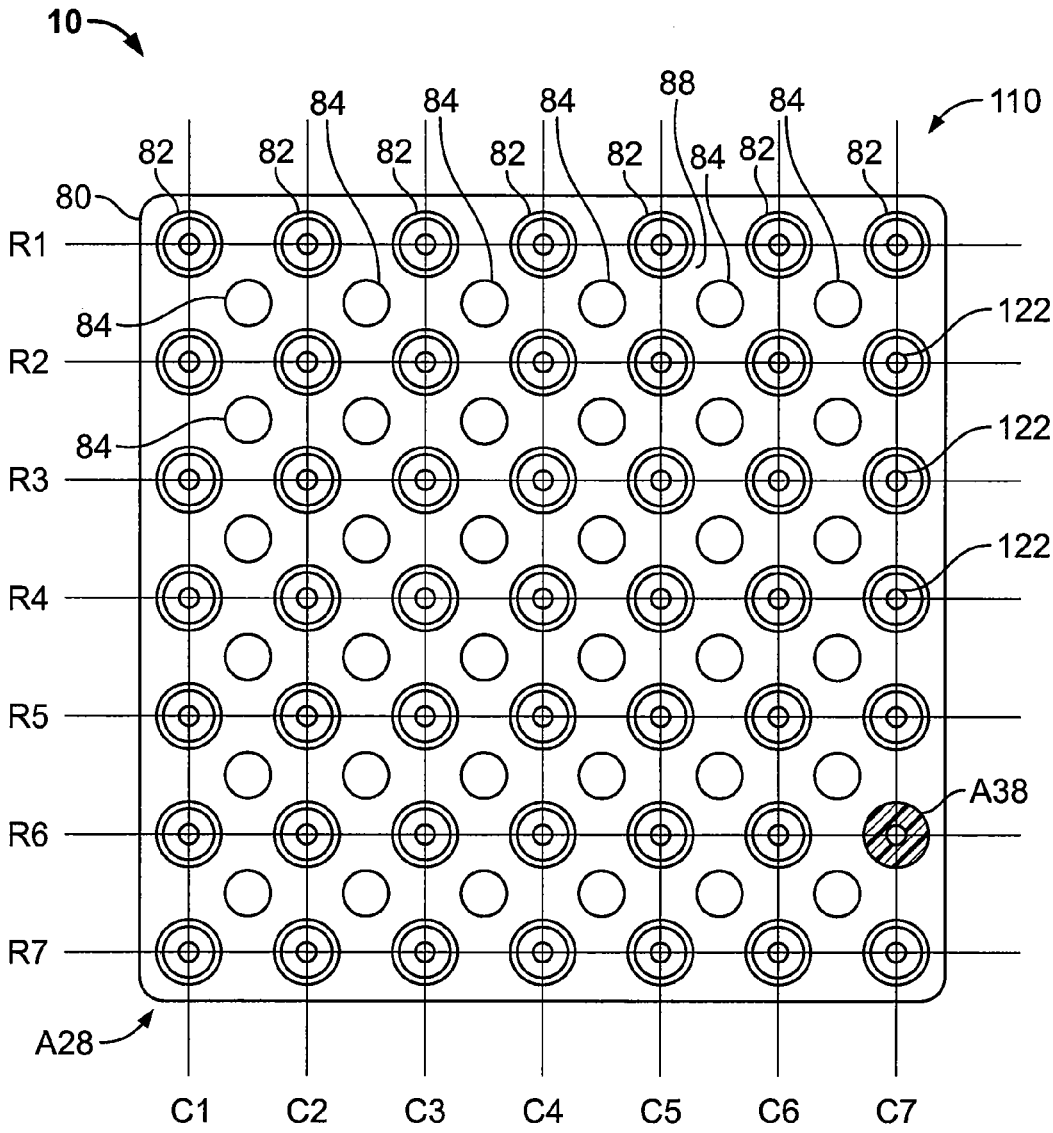
FIG. 11 is a bottom view of the seat cushion of FIG. 8.

As best shown in FIGS. 9-11, the plurality of spacing members 82 are spaced apart and substantially evenly distributed across the second area A28, with each of the plurality of spacing members 82 extending perpendicularly outwardly in a first direction D19 from the support surface 88. The plurality of spacing members 82 each have a second percentage by volume of EVA material and a third percentage of a rubber material, such as for example, the second percentage by volume of EVA material in the spacing members 82 of the seat cushion 10 is greater than or equal to 40% and the third percentage by volume of rubber is less than or equal to 60%, which are evenly mixed throughout the compositions of the plurality of spacing members 82, and may be combined with additional materials in respective percentages. The additional materials may include, at a minimum, polyethylene (PE), color pigment, polycarbonate, and dicumyl peroxide (DCP). The body may have an eighth percentage of PE, a ninth percentage of color pigment, a tenth percentage of polycarbonate, and an eleventh percentage of DCP.

In one embodiment, the plurality of spacing members 82 are spaced on support surface 88 in a two-dimensional pattern 110. Referring to FIG. 11, in one embodiment the two-dimensional pattern 110 is defined by a first matrix of grid points at the intersections of the rows Rx (e.g., rows R1-R7) and columns Cx (e.g., columns C1-C7) of the first matrix, with one spacing member of the plurality of spacing members 82 being located at each grid point of the first matrix of grid points. In one embodiment, the two-dimensional pattern 110 is a rectangular grid having at least three rows of spacing members 82 and at least three columns of spacing members 82, e.g., 7 rows×7 columns.

In one embodiment, each of the plurality of spacing members 82 respectively extend outwardly from the support surface 88 in the first direction D19 (see FIGS. 9 and 10) an equal distance, i.e., length L19, in a range of, for example, about 1.5 to about 3.0 centimeters. Each of the plurality of spacing members 82 are formed from a closed-cell composition that is substantially non-porous, and are distributed across the second area A28 of support surface 88, and are sized in length L19 in the first direction D19. The plurality of spacing members 82 are sized in cross-sectional area A38 orthogonal to the length L19, in combination with the composition, to substantially support the flexible and semi-rigid body 80 without significant flexing of the spacing members 82 or the flexible and semi-rigid body 80. In the present embodiment, for example, the cross-sectional area A38 of each of the plurality of spacing members 82 may be in a range of about four square centimeters to about nine square centimeters.

In one embodiment, the first percentage by volume of EVA material in the body 80 of the seat cushion 10 is greater than or equal to 60%, the forth percentage by volume of PE is less than or equal to 15%, the fifth percentage by volume of color pigment is less than or equal to 5%, the sixth percentage by volume of polycarbonate is less than or equal to 15%, and the seventh percentage by volume of DCP is less than or equal to 10%. The first percentage may range from 59 to 68%. For example, the first percentage is equal to 63%, the fourth percentage is equal to 13%, the fifth percentage is equal to 5%, the sixth percentage is equal to 13% and the seventh percentage is equal to 6%.

In one embodiment, the second percentage by volume of EVA material in the spacing members 82 of the seat cushion 10 is greater than or equal to 40%, the third percentage by volume of rubber is less than or equal to 60%, the eighth percentage by volume of PE is less than or equal to 15%, the ninth percentage by volume of color pigment is less than or equal to 5%, the tenth percentage by volume of polycarbonate is less than or equal to 15%, and the eleventh percentage by volume of DCP is less than or equal to 10%. The second percentage may range from 39 to 49%, and the third percentage may range from 15 to 21%. For example, the second percentage is equal to 44%, the third percentage is equal to 19%, the eighth percentage is equal to 13%, the ninth percentage is equal to 5%, the tenth percentage is equal to 13% and the eleventh percentage is equal to 6%. The percentages of EVA, rubber and additional materials in the body 80 of the seat cushion 10 may be the equal to the percentages of EVA, rubber and additional materials in the spacing members 82. Since all of the force and pressure exerted by the user on the seat cushion 10 is exerted upon the spacing members 82, rubber may be added to the composition of the spacing members in order to increase durability.

Figure 8:
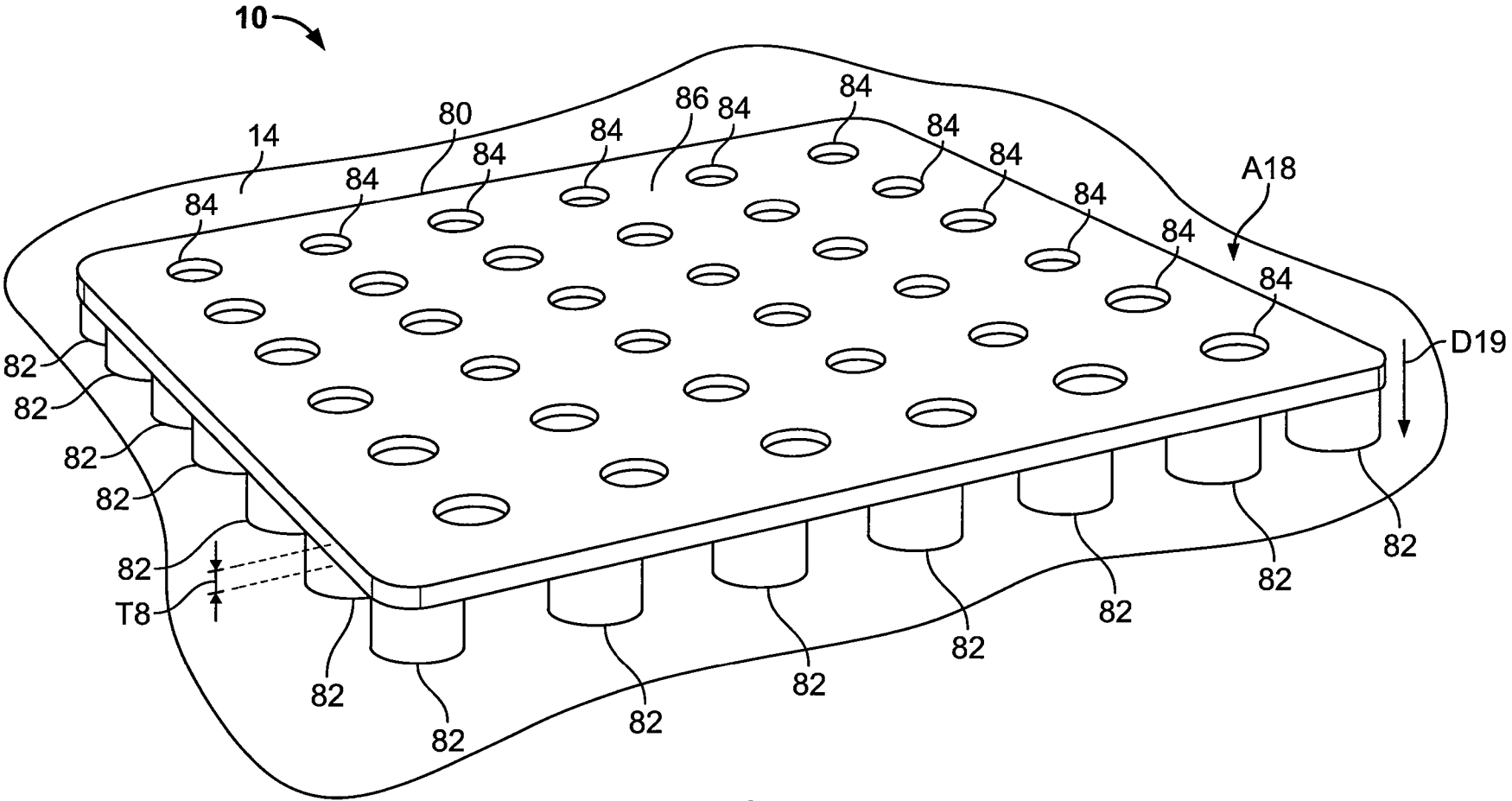
FIG. 8 is a perspective view of the seat cushion of FIG. 1, with the fabric cover removed, viewed from the seating surface side.

The plurality of ventilation holes 84, as shown in FIGS. 8-9, and 11, extend through the flexible and semi-rigid body 80 from the seating surface 86 to the support surface 88. The plurality of ventilation holes 84 are distributed among the plurality of spacing members 82. The plurality of spacing members 82 are spaced and positioned in relation to the plurality of ventilation holes 84 to facilitate ventilation around and between the plurality of spacing members 82, up and through the plurality of ventilation holes 84.

Figure 12:
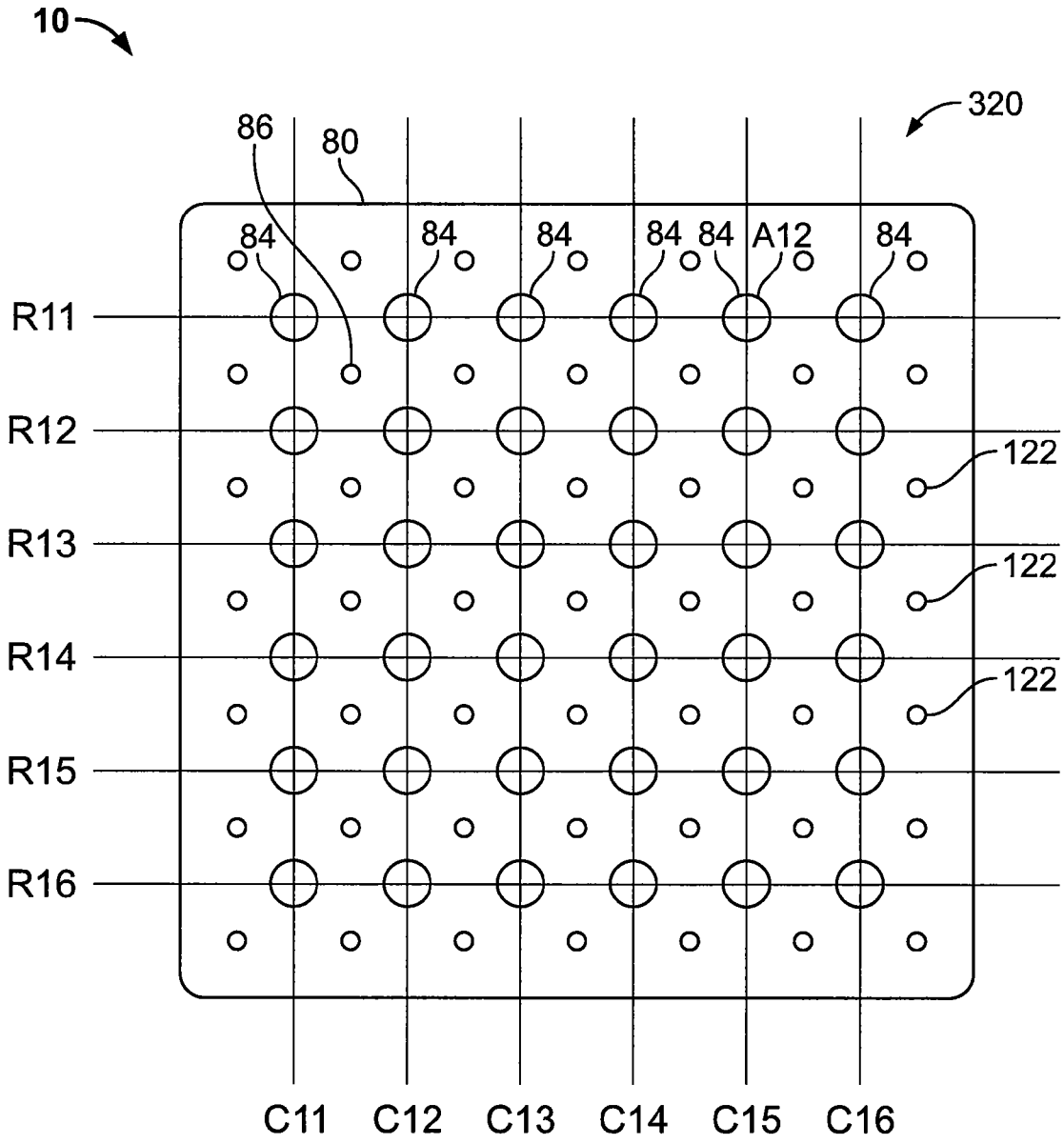
FIG. 12 is a bottom view of the seat cushion of FIG. 8.

Referring also to FIG. 12, in one embodiment, the plurality of ventilation holes 84 are distributed in the flexible and semi-rigid body 80 in a two-dimensional pattern 120 interspersed with the plurality of spacing members 82 that are arranged in the two-dimensional pattern 110 shown in FIG. 11. In the present embodiment, the two-dimensional pattern 120 is defined by a second matrix of grid points at the intersections of the rows R1x (e.g., rows R11-R16) and columns Cly (e.g., columns C11-C16) of the second matrix, with one ventilation hole of the plurality of plurality of ventilation holes 84 being located at each grid point of the second matrix of grid points. In one embodiment, the two-dimensional pattern 120 is a rectangular grid having at least two rows of ventilation holes 84 and at least two columns of ventilation holes 84, e.g., 6 rows ×6 columns.

A cross-sectional area A12, i.e., the opening size, of each of the plurality of ventilation holes 84 may be, for example, in a range of about three square centimeters to about nine square centimeters. The size and quantity of ventilation holes 84 may be chosen to provide the desired amount of ventilation to the human user, while not compromising the structural integrity of flexible body 80. The plurality of spacing members 82 and the flexible body 80 are the only structural elements of the seat cushion 10 which provide support to the seat cushion's user who is sitting on the seating surface 86 of the seat cushion 10 when the spacing members 82 are placed on a solid surface. Also, for additional ventilation, it is contemplated that each spacing member 82 may have a spacing ventilation hole 122 that is centered within each spacing member 82, and is parallel to the length L19 of each spacing member 82. The spacing ventilation holes 122 continue from each spacing member 82 through the support surface 88 of the flexible body 80, through the flexible body 80 and through the seating surface 86 of the flexible body 80.

As a general design criteria, as length L19 increases cross-sectional area A38 may increase as well to retain the desired level on non-flexibility, e.g., support. While each of the plurality of spacing members 82 may be substantially non-flexible in direction D29 radially perpendicular to the first direction D19, the composition provides a level of compression along the length L19 to provide a cushioning effect. In addition, the flexible body 80 is flexible and pliable as a combined effect its thickness T8, the quantity and size of the plurality of ventilation holes 84, and/or the characteristics of the composition.

Figure 13:
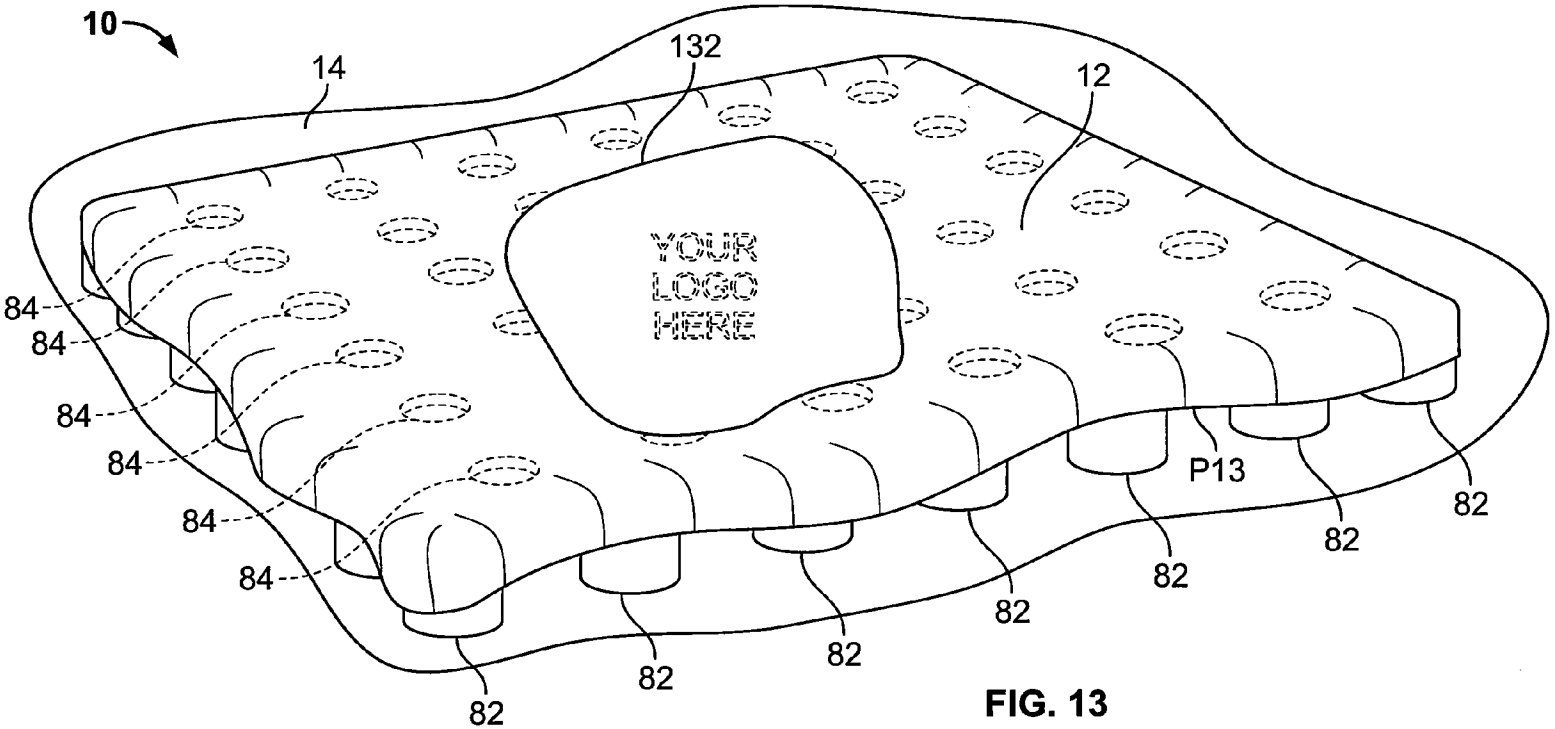
FIG. 13 is the perspective view of the seat cushion of FIG. 8 with the fabric cover installed.

As shown in FIG. 13, in yet another embodiment, the seat cushion 10 of FIGS. 8 to 12, may also have a fabric cover 12. Fabric cover 12 may be made from a porous, i.e., breathable, fabric, and is positioned over seating surface 86 and ventilation holes 84, and around at least a portion of the plurality of spacing members 82. An elastic band installed along the perimeter P13 of the fabric cover may be used to hold the fabric cover 12 on seat cushion 10. Fabric cover 12 may provide, for example, the wicking away of moisture from the user of the seat cushion 10, while maintaining a ventilation path to the user's posterior. The fabric cover 12 may also include, for example, a logo, a symbol or a design, 132, formed on or in the fabric of the fabric cover 12. The fabric cover 12 may be easily cleaned, for example, by placing in a washing machine, or disposed of a replaced with a new fabric cover 12.

Figure 14:
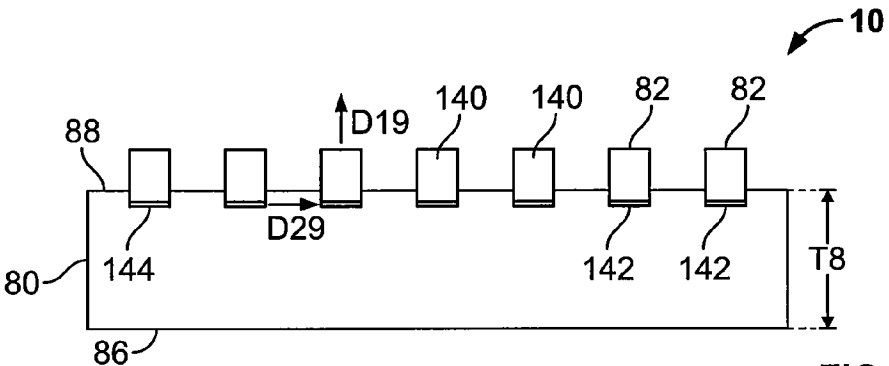
FIG. 14 is a side view of the seat cushion.

As shown in FIG. 14, it is further contemplated that another embodiment of the seat cushion 10 may have a plurality of recesses 140 in the flexible body 80. The plurality of recesses 140 are located on the support surface 88 of the flexible body 80. Each of the plurality of recesses 140 has a recessed surface 142 and a side wall 144, so that each of the plurality of recesses 140 can receive each of the plurality of spacing members 82. A water-resistant glue may be used to connect each of spacing members to at least the recessed surface 142 of each respective recess of the plurality of recesses. Preferably, the depth of each of the recesses 140 is ⅛ inches. Thus, in one embodiment, the thickness T (T2 in FIG. 16) of the body is ⅝ inches, the length/height of the pillars is ⅝ inches, and the depth of the recesses 140 is ⅛ inches. Thus, because ⅛ inch of each of the ⅝ inch pillars 22 fits in to the ⅛ inch recesses 140, the visible length/height of the pillars 22 is ⅜ inches and the overall height the seat cushion is 1 inch.

Figure 15:
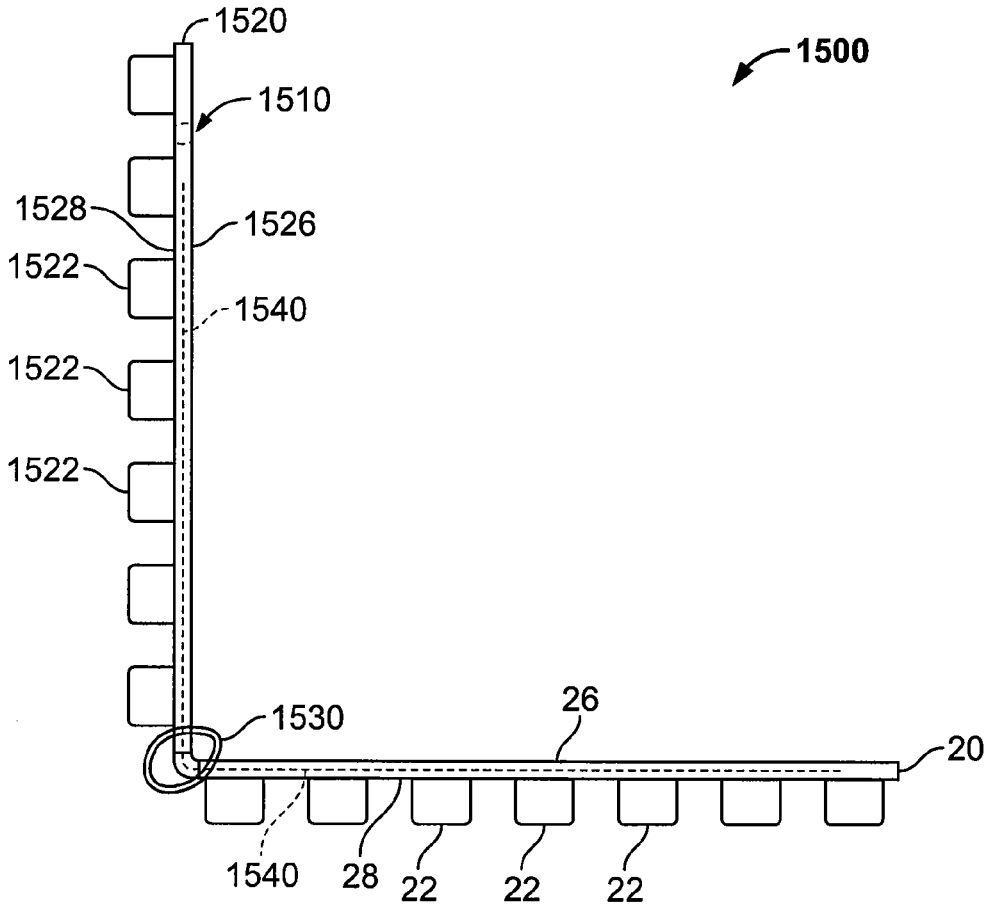
FIG. 15 is a side view of a further embodiment of the seat cushion of the present invention; and, FIG. 16 is a side view of a further embodiment of the seat cushion of the present invention.

Referring to FIG. 15, the seat cushion 1500 can further have a flexible and semi-rigid back body 1520 with a plurality of back body ventilation holes 1510 (only one shown) therein, similar to the above-mentioned body and ventilation holes 84 therein. The back body 1520 can have a backing surface 1526 and a back support surface 1528 spaced apart from the backing surface forming a back body thickness. The backing surface 1526 has a first backing area and the back support surface 1528 has a second back support area. The back body 1520 has a back body composition which can be in part made up of EVA and other materials as described for the body, above. The plurality of back body ventilation holes 1510 extend through the back body from the backing surface 1526 to the back support surface 1528*e*. The back body can also have back body spacing members 1522, and other elements used in relation to the body, as described above. In one embodiment, the body 20 can be attached to the back body 1520 with one or more straps 1530 or other attachment means, which allows for the body 20 and the back body 1520 to fold together for ease of carrying and storage. In another embodiment, the body 20 and the back body can have a rigid relationship. In such an embodiment, a rigid insert sheet, strips or other structure 1540 (shown as a dotted line), made for example from a hard plastic or other rigid and light weight material, can be molded with the body 20 and the back body 1520 to establish and maintain approximately a 90 degree angle (or another appropriate angle for sitting and leaning back on the back body 1520) between the body 20 and the back body 1520. Other means for integrated or attaching the body 20 with the back body 1520 come to mind from the present description, in both the foldable and rigid embodiments.

Figure 16:
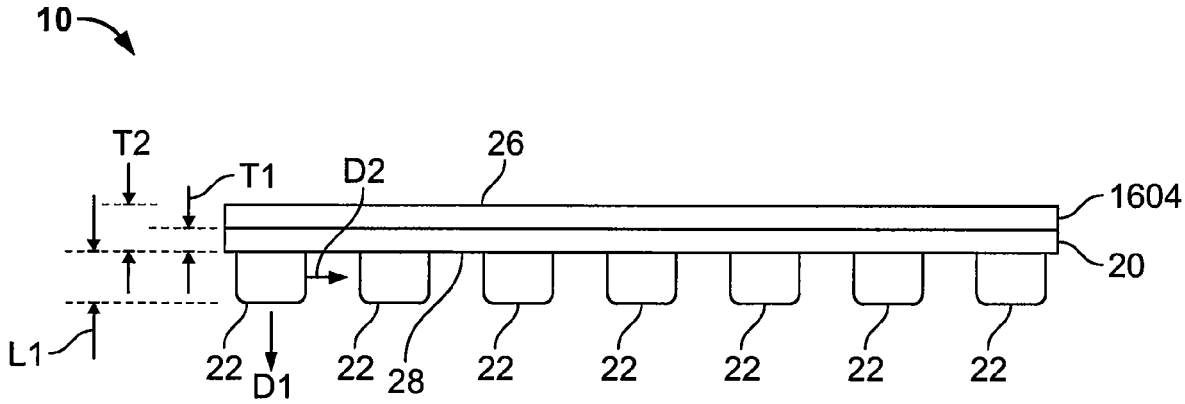

Referring to FIG. 16, a further embodiment of the seat cushion 10 of prior embodiments described herein is shown. Specifically, the seat cushion 10 of FIG. 16 has an additional upper or seat layer 1604 added to the seat cushion 10 of FIG. 4. The seat cushion 10 has the fabric cover 12 removed for clarity. In the present embodiment, seat cushion 10 includes a flexible and semi-rigid body 20 and a plurality of spacing members 22. The additional or upper layer 1604 is attached to the body 20 or made integral therewith, but is made of a different material and/or composition than the body 20 of FIG. 4. As in the prior embodiments, the flexible body 20 of FIG. 16 includes a plurality of ventilation holes 24. Similarly, flexible body 20 and the plurality of spacing members 22 may be formed, for example, as a one-piece or multi-piece unitary structure from a closed cell composition, such as for example, a closed-cell structure having a hardness of about 40 on the Shore durometer scale, with the additional layer 1604 attached to the body 20, as shown. The components and/or structure described herein, including the upper layer 1604, may be fabricated using injection molding techniques known in the art. The upper layer 1604 may also be made of a polymer or plastic for support of the user's body applying a force to the upper layer 1604.

The upper layer 1604 has a seating surface 26 and the flexible body 20 has a support surface 28 spaced apart from seating surface 26. In the present embodiment, the thickness T2 of flexible body 20 and the upper layer 1604 may be, for example, in a range of about 0.4 to 1.0 centimeters. Thickness T1 will be at least half of T2, and will preferably be at least 75 percent of T2, depending on the material used for the upper layer 1604, and/or the material used for the body 20.

While this invention has been described with respect to an embodiment of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A seat cushion, comprising:

a flexible and semi-rigid body having a seating surface and a substantially smooth support surface spaced apart from the seating surface forming a body thickness, the seating surface having a first area and the support surface having a second area, wherein the body has a body composition with a first percentage by volume of Ethylene Vinyl Acetate, and wherein the EVA is substantially evenly mixed throughout the body composition with additional materials in respective percentages;

a plurality of spacing members spaced apart and substantially evenly distributed across the second area, with each of the plurality of spacing members extending outwardly in a first direction from the support surface, wherein the plurality of spacing members each has a spacing member composition with a second percentage by volume of EVA and with a third percentage by volume of rubber, and wherein the EVA and the rubber are substantially evenly mixed throughout the composition of the plurality of spacing members with additional materials in respective percentages; and, a plurality of ventilation holes extending through the body from the seating surface to the support surface, the plurality of ventilation holes being distributed among the plurality of spacing members and spaced to facilitate ventilation around and between the plurality of spacing members and the plurality of ventilation holes;

wherein the first percentage of EVA is not equal to the second percentage of EVA and the elasticity of the body is not equal to the elasticity of the spacing members.

2. The seat cushion of claim 1 wherein the additional materials are selected from a group consisting of polyethylene, color pigment, polycarbonate, and dicumyl peroxide.

3. The seat cushion of claim 1 wherein the first percentage is greater than or equal to 60%.

4. The seat cushion of claim 1 wherein the first percentage ranges from 59 to 68%.

5. The seat cushion of claim 1 wherein the first percentage is equal to 63%.

6. The seat cushion of claim 1 wherein the body composition further has a fourth percentage of polyethylene.

7. The seat cushion of claim 6 wherein the fourth percentage is less than or equal to 15%.

8. The seat cushion of claim 6 wherein the fourth percentage is equal to 13%.

9. The seat cushion of claim 6 wherein the body composition has a fifth percentage of color pigment. 1

10. The seat cushion of claim 9 wherein the fifth percentage is less than or equal to 5%. 1

11. The seat cushion of claim 9 wherein the fifth percentage is equal to 5%.

12. The seat cushion of claim 9 wherein the body composition has a sixth percentage of polycarbonate material.

13. The seat cushion of claim 12 wherein the sixth percentage is less than or equal to 15%.

14. The seat cushion of claim 12 wherein the sixth percentage is equal to 13%.

15. The seat cushion of claim 12 wherein the body composition has a seventh percentage of dicumyl peroxide.

16. The seat cushion of claim 15 wherein the seventh percentage is less than or equal to 10%.

17. The seat cushion of claim 15 wherein the seventh percentage is equal to 6%.

18. The seat cushion of claim 1 wherein the second percentage is greater than or equal to 40% and wherein the third percentage is less than or equal to 60%.

19. The seat cushion of claim 1 wherein the second percentage ranges from 39 to 49% and wherein the third percentage ranges from 15 to 21%.

20. The seat cushion of claim 1 wherein the second percentage is equal to 44% and wherein the third percentage is equal to 19%.

21. The seat cushion of claim 1 wherein the second and third percentages are the same.

22. The seat cushion of claim 15 wherein the spacing member composition has an eighth percentage of polyethylene.

23. The seat cushion of claim 22 wherein the eighth percentage is less than or equal to 15%.

24. The seat cushion of claim 22 wherein the eighth percentage is equal to 13%.

25. The seat cushion of claim 22 wherein the spacing member composition has a ninth percentage of color pigment.

26. The seat cushion of claim 25 wherein the ninth percentage is less than or equal to 5%.

27. The seat cushion of claim 25 wherein the ninth percentage is equal to 5%.

28. The seat cushion of claim 25 wherein the spacing member composition has a tenth percentage of polycarbonate.

29. The seat cushion of claim 28 wherein the tenth percentage is less than or equal to 15%.

30. The seat cushion of claim 28 wherein the tenth percentage is equal to 13%.

31. The seat cushion of claim 28 wherein the spacing member composition has an eleventh percentage of dicumyl peroxide.

32. The seat cushion of claim 31 wherein the eleventh percentage is less than or equal to 10%.

33. The seat cushion of claim 31 wherein the eleventh percentage is equal to 6%.

34. The seat cushion of claim 1 wherein the spacing members are spaced in a two-dimensional pattern which is defined by a matrix of grid points with each spacing member of the plurality of spacing members being located at each grid point of the matrix of grid points.

35. The seat cushion of claim 1 wherein each of the plurality of spacing members respectively extend outward from the support surface in the first direction an equal distance in a range of about 1.5 to about 3.0 centimeters.

36. The seat cushion of claim 1 wherein the body and the plurality of spacing members are formed as a one-piece unitary structure.

37. The seat cushion of claim 1 wherein the composition is a closed-cell composition, which is substantially non-porous.

38. The seat cushion of claim 1 wherein the plurality of spacing members are sized in length in the first direction and sized in cross-sectional area orthogonal to the length, in combination with the composition, to substantially support the flexible and semi-rigid body wherein each of the plurality of spacing members are substantially non-flexible in a direction radially perpendicular to the first direction.

39. The seat cushion of claim 38 wherein the cross-sectional area of each of the plurality of spacing members is in a range of about four square centimeters to about nine square centimeters.

40. The seat cushion of claim 1 further comprising a fabric cover having an elastic perimeter for positioning and maintaining the fabric cover over the seating surface.

41. The seat cushion of claim 40 further comprising at least one of a logo, a symbol, or a design formed on or in the fabric of the fabric cover.

42. The seat cushion of claim 1 wherein the plurality of spacing members are distributed on the support surface in a first two-dimensional pattern, and the plurality of ventilation holes are distributed in the body in a second two-dimensional pattern interspersed with the plurality of spacing members, wherein the first two-dimensional pattern is defined by a first matrix of grid points with each spacing member of the plurality of spacing members being located at each grid point of the first matrix of grid points, and wherein the second two-dimensional pattern is defined by a second matrix of grid points with each ventilation hole of plurality of ventilation holes being located at each grid point of the second matrix of grid points.

43. The seat cushion of claim 1 wherein a cross-sectional area of each of the plurality of ventilation holes is in a range of about three square centimeters to about nine square centimeters.

44. The seat cushion of claim 1 wherein the plurality of spacing members and the body are the only structural elements which provide support for a user sitting on the seating surface of the seat cushion when the spacing members are placed on a solid surface.

45. The seat cushion of claim 1 further comprising:

a plurality of recesses in the body located on the support surface of the body, each of the plurality of recesses having a recessed surface and a side wall, wherein each of the plurality of recesses receives each of the plurality of spacing members, and wherein a water-resistant glue is used to connect each spacing member to at least the recess surface of each respective recess of the plurality of recesses.

46. The seat cushion of claim 1, wherein each spacing member comprises a spacing ventilation hole substantially centered within each spacing member and parallel to the length of each spacing member, wherein each spacing ventilation hole continues from each spacing member through the support surface of the body, through the body and through the seating surface of the body.

47. The seat cushion of claim 1 further comprising:

a flexible and semi-rigid back body having a backing surface and a back support surface spaced apart from the backing surface forming a back body thickness, the backing surface having a first backing area and the back support surface having a second back support area, wherein the back body has a back body composition comprising EVA; and, a plurality of back body ventilation holes extending through the back body from the backing surface to the back support surface.

48. The seat cushion of claim 47 wherein the back body further comprises the same elements as the body of claim 1.

49. The seat cushion of claim 1 wherein no further supporting structure is included to hold the seat cushion in place when in use.

* * * * *